US009991061B1

(12) United States Patent
Tang

(10) Patent No.: US 9,991,061 B1
(45) Date of Patent: Jun. 5, 2018

(54) TOGGLE ELECTRO-MECHANICAL ASSEMBLY

(71) Applicant: HYDRA-ELECTRIC COMPANY, Burbank, CA (US)

(72) Inventor: John Chick Hong Tang, Monterey Park, CA (US)

(73) Assignee: HYDRA-ELECTRIC COMPANY, Burbank, CA (US)

( * ) Notice: Subject to any disclaimer, the term of this patent is extended or adjusted under 35 U.S.C. 154(b) by 71 days.

(21) Appl. No.: 15/176,907

(22) Filed: Jun. 8, 2016

Related U.S. Application Data

(60) Provisional application No. 62/173,263, filed on Jun. 9, 2015.

(51) Int. Cl.
*H01H 5/00* (2006.01)
*H01H 5/30* (2006.01)
*H01H 3/02* (2006.01)

(52) U.S. Cl.
CPC ..... *H01H 5/30* (2013.01); *H01H 3/02* (2013.01)

(58) Field of Classification Search
CPC ..... H01H 5/30; H01H 3/02
USPC ..... 200/401, 405, 408, 406, 286
See application file for complete search history.

(56) References Cited

U.S. PATENT DOCUMENTS 2,516,236 A * 7/1950 Moorhead ..... H01H 13/48 200/406
3,736,395 A * 5/1973 Miller ..... H01H 13/12 200/406
4,109,121 A * 8/1978 Bauer ..... H01H 11/00 200/249

* cited by examiner

*Primary Examiner* — Edwin A. Leon
*Assistant Examiner* — Lheiren Mae A Caroc
(74) *Attorney, Agent, or Firm* — Brooks Acordia IP Law, PC; Michael Zarrabian

(57) ABSTRACT

An assembly including: a disk spring; a plurality of normally closed contacts disposed in a plane below the disk spring; a plurality of normally open contacts disposed in a plane above the disk spring; a pivot ring supporting a lower surface of the disk spring; and an actuating pin having a shoulder in contact with an upper surface of the disk spring; where a movement of the actuating pin away from a header assembly snap deflects the disk spring to a first position to contact the plurality of normally open contacts, and a movement of the actuating pin towards the header assembly snap deflects the disk spring to a second position to contact the plurality of normally closed contacts.

19 Claims, 8 Drawing Sheets

TOGGLE ELECTRO-MECHANICAL ASSEMBLY

CROSS-REFERENCE TO RELATED APPLICATIONS

This applications claims priority to and the benefit of U.S. Provisional Application No. 62/173,263, filed Jun. 9, 2015, the disclosure of which is incorporated by reference herein for all purposes.

TECHNICAL FIELD

The invention, in its several embodiments, pertains to switches, and more particularly to switch assemblies.

BACKGROUND

A pressure switch is a form of switch that closes an electrical contact when a certain set pressure has been reached on its input. The switch may be designed to make contact either on pressure rise or on pressure fall. The switch may detect pressure rise in various media such as fluids.

SUMMARY

An exemplary assembly embodiment may include: a disk spring; a plurality of normally closed contacts disposed in a plane below the disk spring; a plurality of normally open contacts disposed in a plane above the disk spring; a pivot ring supporting a lower surface of the disk spring; and an actuating pin having a shoulder in contact with an upper surface of the disk spring; where a movement of the actuating pin away from a header assembly snap deflects the disk spring to a first position to contact the plurality of normally open contacts, and a movement of the actuating pin towards the header assembly snap deflects the disk spring to a second position to contact the plurality of normally closed contacts.

Additional exemplary assembly embodiments may include an adjustment pin rotatably connected to the actuating pin; where rotating the adjustment pin in a first direction extends an overall length of the adjustment pin and actuating pin, and rotating the adjustment pin in a second direction reduces the overall length of the adjustment pin and actuating pin. Additional exemplary assembly embodiments may include a yoke; where a movement of the yoke towards the header assembly causes the movement of the actuating pin away from the header assembly, and a movement of the yoke away from the header assembly causes the movement of the actuating pin towards the header assembly.

Additional exemplary assembly embodiments may include a first pivoting pin having a proximate end disposed in a first dimple of the adjustment pin, a distal end disposed through a first aperture in the yoke, and a bulbous pivot point disposed in a first aperture of a housing of the assembly; a first bellows disposed about the first pivoting pin; a second pivoting pin having a proximate end disposed in a second dimple of the adjustment pin, a distal end disposed through a second aperture in the yoke, and a bulbous pivot point disposed in a second aperture of a housing of the assembly; and a second bellows disposed about the second pivoting pin; where the first pivoting pin is diametrically opposed from the second pivoting pin.

In additional exemplary assembly embodiments, the movement of the yoke towards the header assembly causes: a movement towards the header assembly of the distal ends of the first and second pivoting pins relative to the bulbous pivot points and a movement away from the header assembly of the proximate ends of the first and second pivoting pins relative to the bulbous pivot points. In additional exemplary assembly embodiments, the movement of the yoke away from the header assembly causes: a movement away from the header assembly of the distal ends of the first and second pivoting pins relative to the bulbous pivot points and a movement towards the header assembly of the proximate ends of the first and second pivoting pins relative to the bulbous pivot points.

In additional exemplary assembly embodiments, the plurality of normally closed contacts includes three normally closed contacts. In additional exemplary assembly embodiments, the plurality of normally open contacts includes three normally open contacts. In additional exemplary assembly embodiments, the plurality of normally open contacts may be each disposed equidistant from a center of the disk spring. In additional exemplary assembly embodiments, the plurality of normally closed contacts may be each disposed equidistant from the center of the disk spring. In additional exemplary assembly embodiments, each of the plurality of normally open contacts are disposed closer to the center of the disk spring than each of the plurality of normally closed contacts.

In additional exemplary assembly embodiments, the disk spring, the plurality of normally closed contacts, and the plurality of normally open contacts may be disposed in a hermetically sealed chamber in a housing of the assembly. In additional exemplary assembly embodiments, the disk spring may include a plurality of "L" shaped apertures extending radially out from a center of the disk spring. In additional exemplary assembly embodiments, the yoke may further include a dimple disposed in a center of a lower surface of the yoke, where the dimple is dimensioned to engage a spherical contact surface of a switch actuator of a switch. In additional exemplary assembly embodiments, the actuating pin may be connected to a central common terminal.

BRIEF DESCRIPTION OF THE DRAWINGS

Embodiments of the present invention are illustrated by way of example and not limitation in the figures of the accompanying drawings, which may not be drawn to scale, and in which.

DETAILED DESCRIPTION

The description herein is made for the purpose of illustrating the general principles of the embodiments discloses herein and is not meant to limit the concepts disclosed herein. Further, particular features described herein can be used in combination with other described features in each of the various possible combinations and permutations. Unless otherwise specifically defined herein, all terms are to be given their broadest possible interpretation including meanings implied from the description as well as meanings understood by those skilled in the art and/or as defined in dictionaries, treatises, etc.

A toggle assembly is disclosed herein for switching between a plurality of normally open electrical contacts and a plurality of normally closed electrical contacts. An example application of the disclosed toggle assembly is in a pressure switch. Further, an electro-mechanical switch including said toggle assembly is disclosed herein, wherein in one example the electro-mechanical switch is a pressure switch.

In one embodiment, the toggle assembly comprises a disk spring that is supported between a shoulder of an actuating pin on a top surface of the disk spring and a pivot ring on a lower surface of the disk spring. Force on a yoke from a switch (e.g., a pressure switch mechanism) snap deflects the disk spring between first and second positions to contact the plurality of normally open contacts or the plurality of normally closed contacts. In one embodiment, the disk spring serves as a common contact along with the plurality of contacts to provide redundancy in operation and ensure continued operation as well as vibration resistance, shock resistance, and heat resistance. In a preferred embodiment, the entire disk spring serves as a common contact along with the plurality of contacts.

In one embodiment, the toggle assembly can be used as a component coupled to other switches components such as a receptacle, switch housing, actuating mechanism and its associated components, and pressure port fitting and its associated components.

Figure 1A:
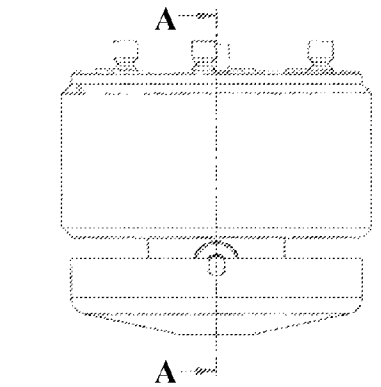
FIG. 1A shows a side view of an embodiment of an electro-mechanical toggle assembly.
Figure 1B:
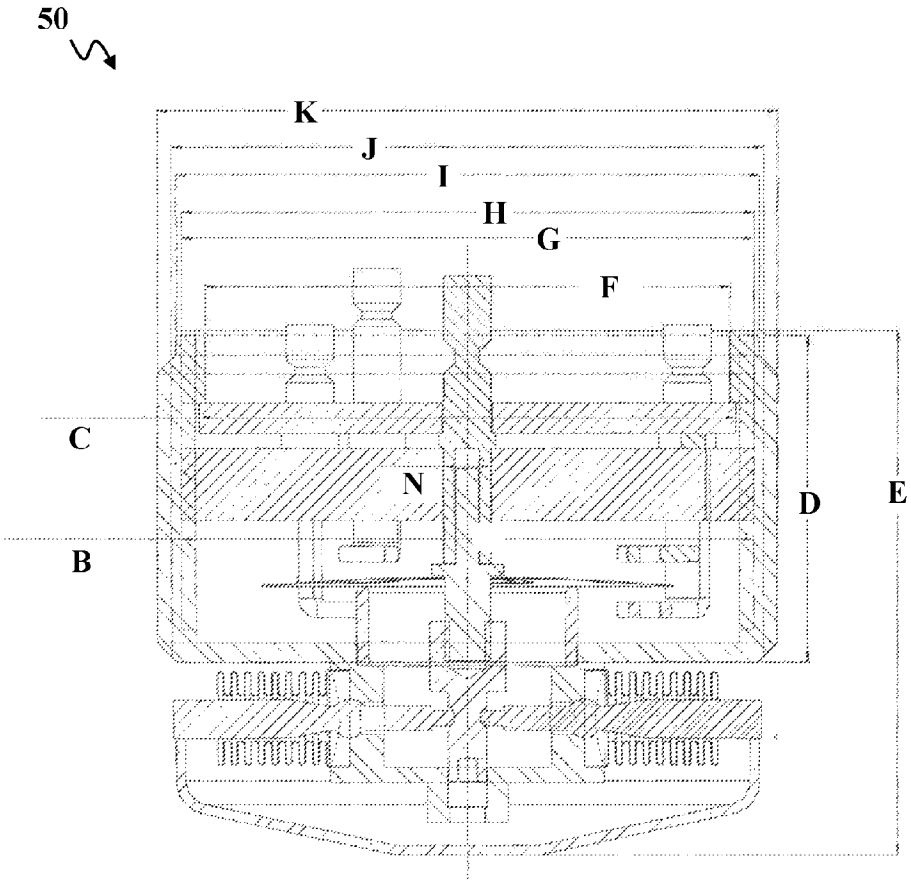
FIG. 1B shows a lengthwise cross-section view of the toggle assembly of FIG. 1A about line A-A.
Figure 2C:
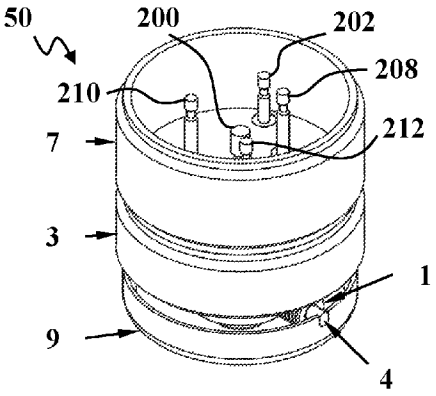
FIG. 2C shows a perspective view of the toggle assembly of FIG. 2A.
Figure 2B:
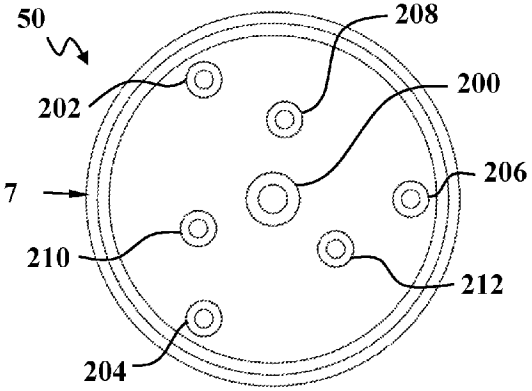
FIG. 2B shows a top view of the toggle assembly of FIG. 2A.
Figure 2A:
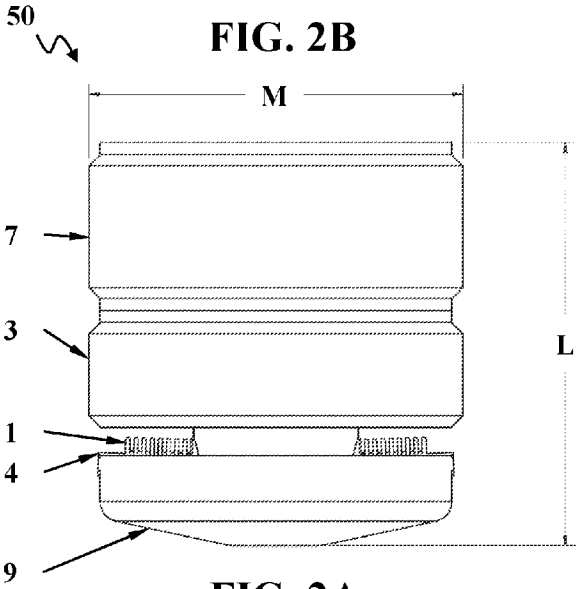
FIG. 2A shows a side view of the toggle assembly of FIG. 1A rotated 90 degrees.

FIG. 1A shows a side view of an exterior of an embodiment of an electro-mechanical switch comprising a toggle assembly 50, disclosed herein, in constructed (assembled) form. FIG. 1B shows a lengthwise cross-section view of the interior of the toggle assembly 50 of FIG. 1A about line A-A. FIG. 2A shows a side view of the toggle assembly 50 of FIG. 1A rotated 90 degrees. FIG. 2B shows a top view of the toggle assembly 50 of FIG. 2A, with its electrical contacts exposed. FIG. 2C shows a perspective view of the toggle assembly 50 of FIG. 2A, with its electrical contacts exposed.

In one embodiment, the toggle assembly 50 includes a header assembly 7 having a plurality of normally open contacts 10 and normally closed electrical contacts 11 with contact leads. The toggle assembly 50 is configured for switching between the plurality of normally open electrical contacts 10 (with leads 208, 210, 212), and the plurality of normally closed electrical contacts 11 (with leads 202, 204, 206). An example application of the disclosed toggle assembly 50 is in a pressure switch. Further, an electro-mechanical switch including said toggle assembly is disclosed herein, wherein in one example the electro-mechanical switch is a pressure switch.

In one embodiment, the disclosed toggle assembly 50 comprises: a yoke 9, two diametrically opposed pivoting pins 4, bellows 1 disposed about each of the pivoting pins 4, an adjustment pin 2, an actuator pin 6 rotatably connected to the adjustment pin 2 (e.g., actuator pin 6 is threaded into adjustment pin 2) and slidably connected to a central common terminal 200 (e.g., actuator pin 6 is inserted into a hollow of the central common terminal 200), a pivoting ring 5 in contact with a bottom surface of a disk spring 8, said plurality of normally open contacts 10, and said plurality of normally closed contacts 11.

In one embodiment, the toggle assembly further comprises a disk spring 8 that is supported between a shoulder 404 of the actuating pin 6 on a top surface of the disk spring 8 and a pivot ring 5 on a lower surface of the disk spring. Force on a yoke 9 from a switch (e.g., a pressure switch mechanism) snap deflects the disk spring 8 between first and second positions to contact the plurality of normally open contacts 10 or the plurality of normally closed contacts 11. In one embodiment, the disk spring 8 serves as a common contact along with the plurality of contacts to provide redundancy in operation and ensure continued operation as well as vibration resistance, shock resistance, and heat resistance. In a preferred embodiment, the entire disk spring 8 serves as a common contact along with the plurality of contacts.

In one embodiment, the toggle assembly 50 can be used as a component coupled to other switch components such as a receptacle, switch housing, actuating mechanism and its associated components, and pressure port fitting and its associated components.

As noted, the toggle assembly 50 further includes said header assembly 7 having a plurality of electrical contacts with said contact leads. The electrical contact leads can be connected to wires in a switch configuration, electrically coupled to an electrical circuit, for opening/closing the electrical circuit. In the example embodiments described herein, said electrical contact leads include a central common terminal 200; a plurality of normally closed electrical contact leads 202, 204, 206; and a plurality of normally open electrical contact leads 208, 210, 212. The plurality of normally closed contact leads may include three normally closed contact leads 202, 204, 206. The plurality of normally open contact leads may include three normally open contact leads 208, 210, 212.

The plurality of normally closed contact leads 202, 204, 206 may each be disposed equidistant from a center 201 of a disk spring and/or a common terminal 200. The plurality of normally open contact leads 208, 210, 212 may each be disposed equidistant from a center of a disk spring 201 and/or a common terminal 200. The plurality of normally open contact leads 208, 210, 212 may be disposed closer to the center of the disk spring and/or common terminal than each of the plurality of normally closed contact leads 202, 204, 206 may each be disposed equidistant from a center of a disk spring and/or a common terminal 200.

Figure 3:
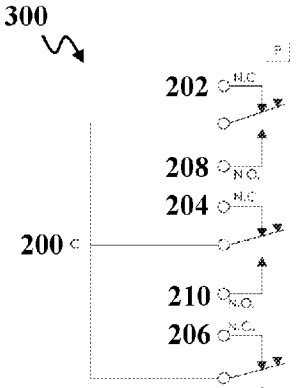
FIG. 3 is a wiring diagram of the toggle assembly of FIG. 2A.

FIG. 3 shows an example wiring diagram 300 of the toggle assembly of FIG. 2A. There are three normally closed electrical contact leads 202, 204, and 206 and three normally open electrical contact leads 208, 210, 212. Increasing pressure on a yoke 9 of the toggle assembly may break contact between the common terminal 200 and the normally closed contact leads 202, 204, 206 and establish contact between the common terminal 200 and the normally open contact leads 208, 210, 212. Decreasing pressure on the yoke 9 of the toggle assembly may break contact between the common terminal 200 and the normally open contact leads 208, 210, 212 and re-establish contact between the common terminal 200 and the normally closed contact leads 202, 204, 206, e.g., at zero pounds per square inch gage (PSIG).

The common terminal 200 is always in contact with either the normally open contact leads 208, 210, 212 or the normally closed contact leads 202, 204, 206 in the disclosed embodiment, i.e., the common terminal 200 is in contact with either plurality of contact leads. Having a plurality of contact leads establishes a redundancy in the event that one of the plurality of contact leads malfunctions. For example, a traditional microswitch may have only a single contact lead with a small contact area enclosed in a hermetical seal. In certain applications, the hermetical seal may be breached and corrosion to the contact and/or contact area may occur resulting in failure of the microswitch. In the disclosed toggle assembly 50, even if a hermetical seal is breached, the much larger contact area of the disk spring combined with the redundant plurality of contacts ensures a longer lifespan even in circumstances with higher temperatures, pressures, gasses, vibration, and shock.

Figure 4:
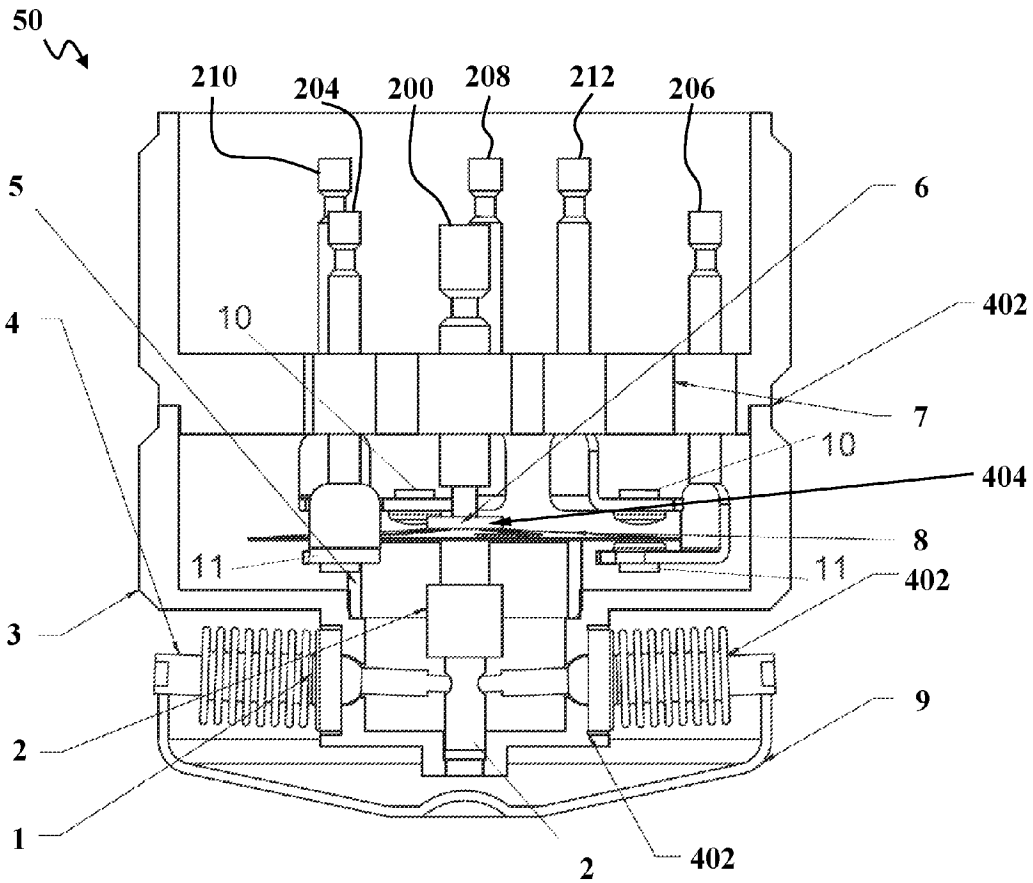
FIG. 4 shows a cross-section view showing the component parts of the toggle assembly of FIG. 2A.
Figure 5:
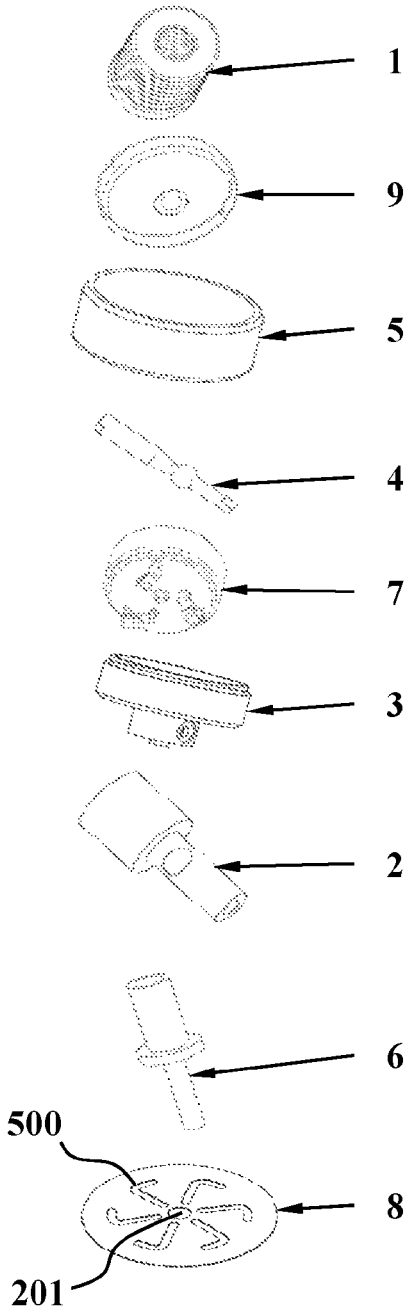
FIG. 5 shows the component parts of the toggle assembly of FIG. 2A.
Figure 6A:
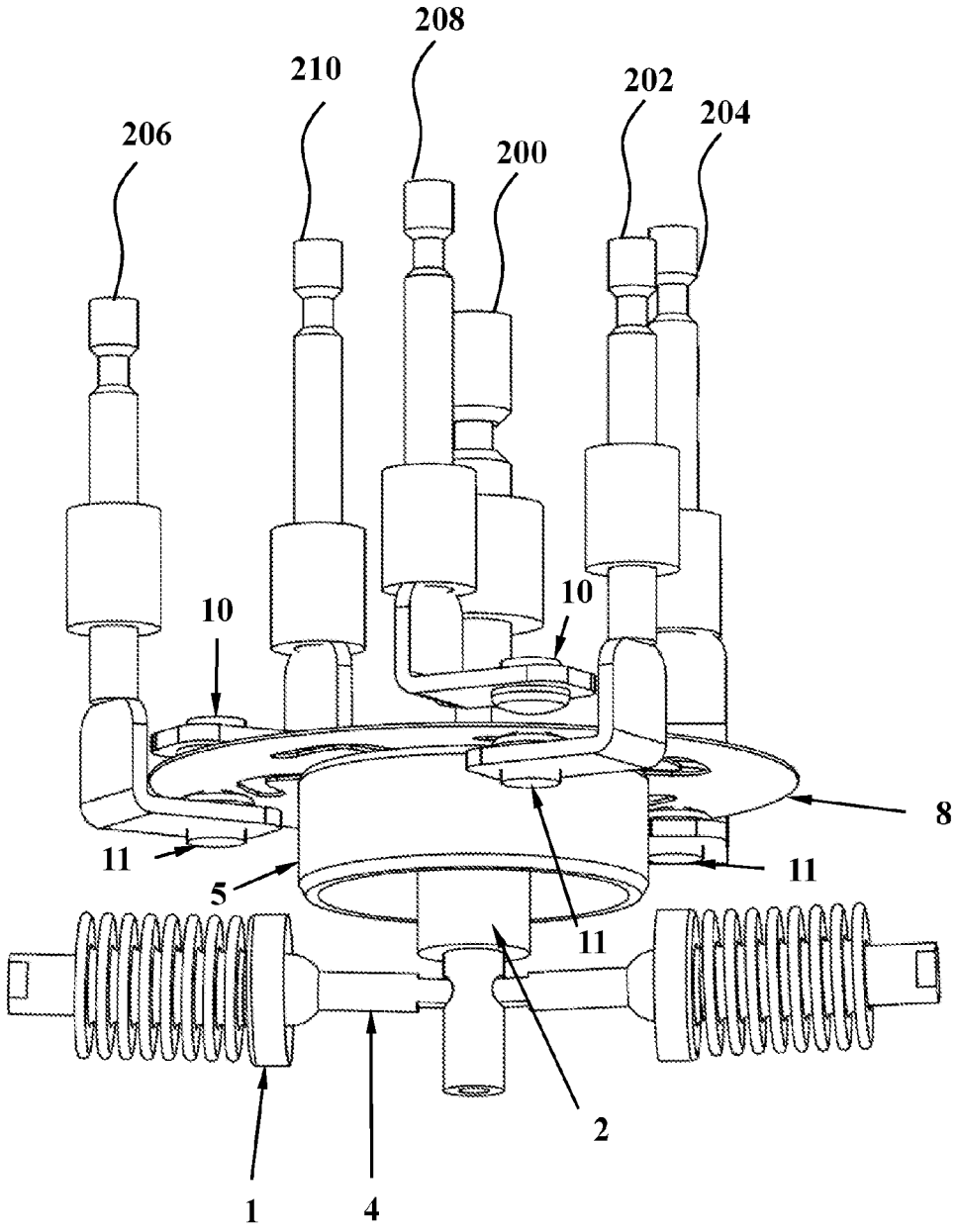
FIGS. 6A-6B show perspective views of the toggle assembly of FIG. 2A.
Figure 6B:
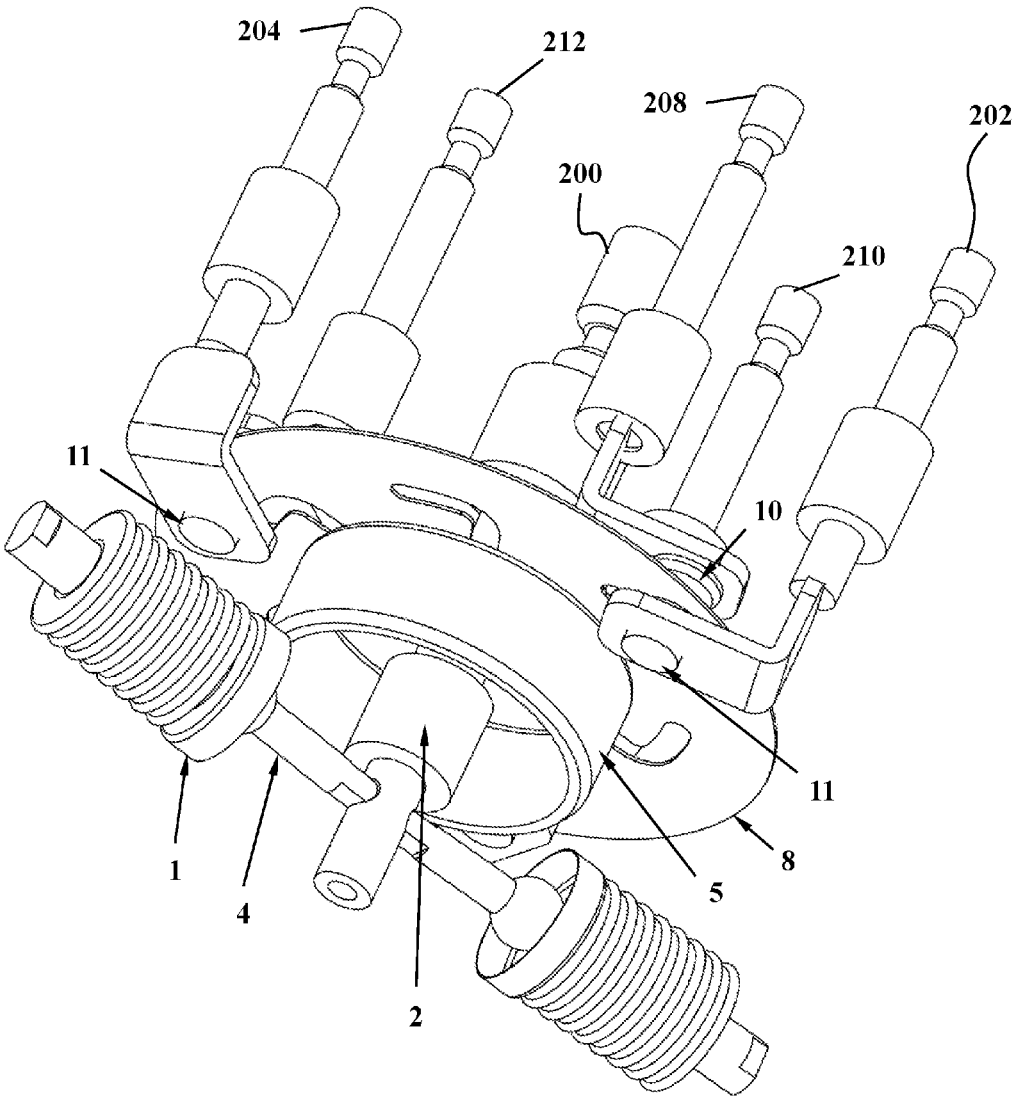
Figure 7:
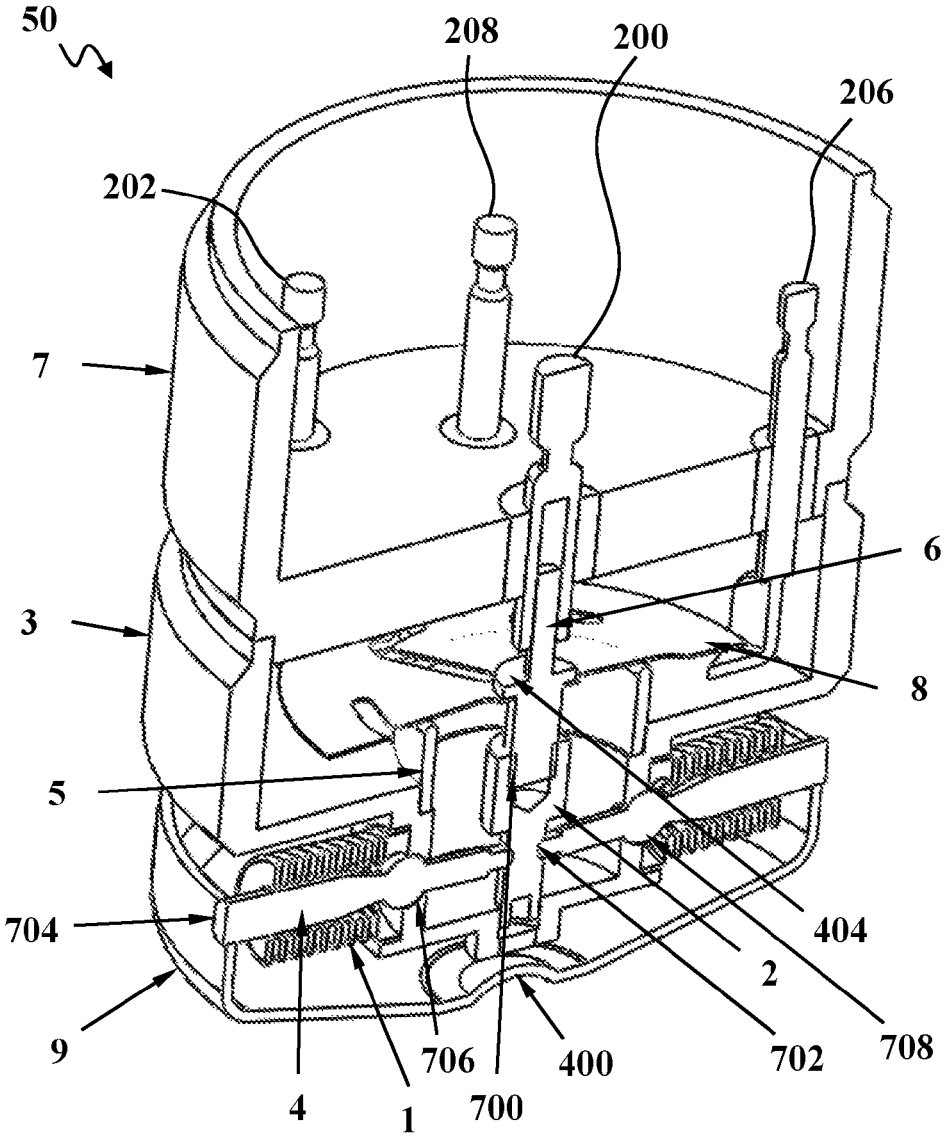
FIG. 7 shows a perspective cross-section view of the toggle assembly of FIG. 2A.
Figure 8B:
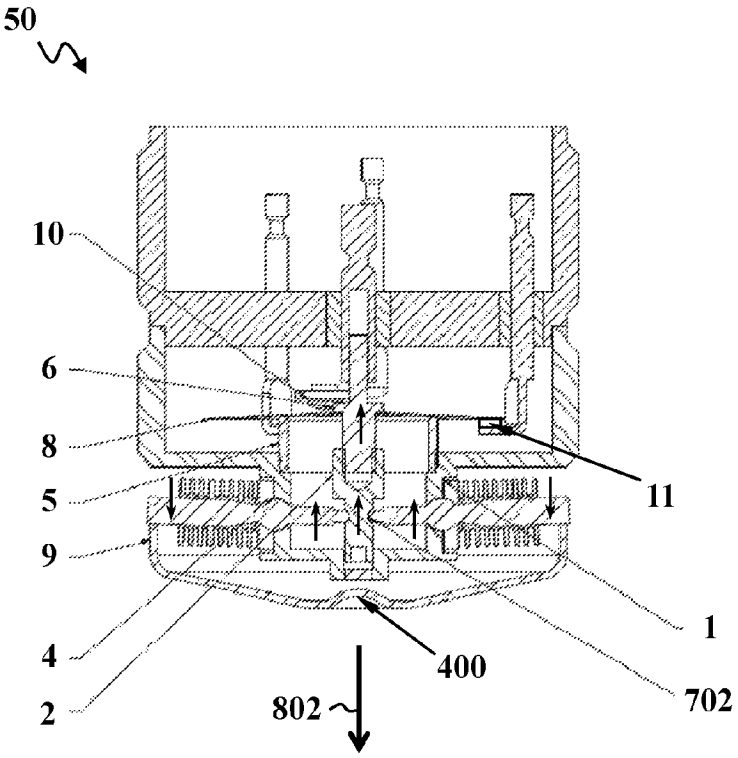
FIG. 8B shows an unsnapped mode of the toggle assembly of FIG. 2A.
Figure 8A:
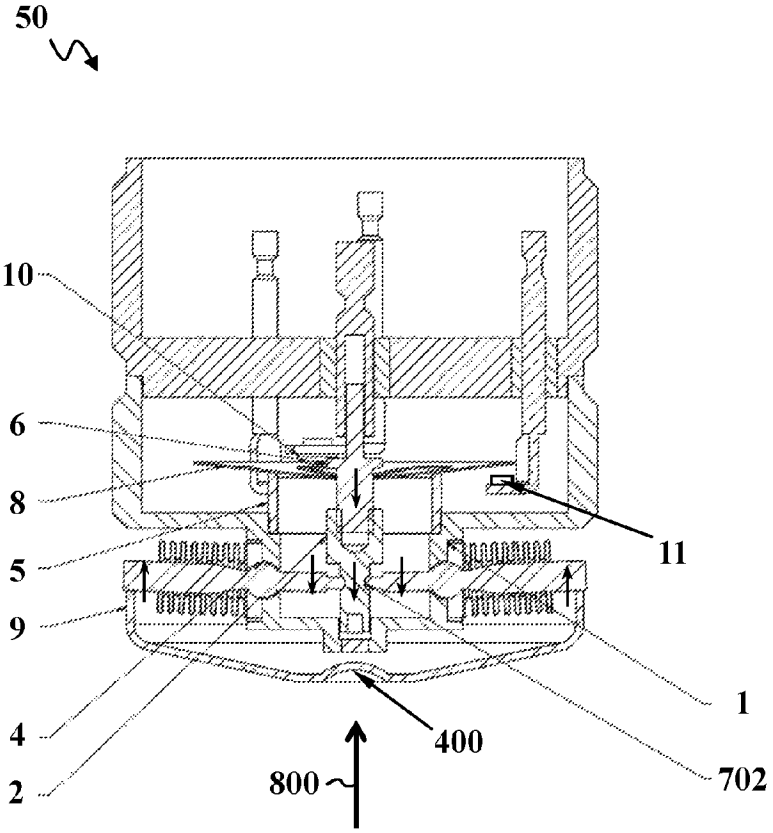
FIG. 8A shows a snapped mode of the toggle assembly of FIG. 2A.

FIG. 4 shows a cross-section view showing the component parts of the toggle assembly 50 of FIG. 2A. FIG. 5 shows the component parts of the toggle assembly of FIG. 2A. FIGS. 6A-6B show perspective views of the toggle assembly 50 of FIG. 2A. FIG. 7 shows a perspective cross-section view of the toggle assembly 50 of FIG. 2A. FIG. 8A shows a snapped mode of the toggle assembly 50 of FIG. 2A. FIG. 8B shows an unsnapped mode of the toggle assembly 50 of FIG. 2A.

Referring to FIG. 4, various components of the toggle assembly 50 may be laser welded 402 to create a hermetic seal in an electrical compartment housing 3. The yoke 9 may include a dimple 400 (FIG. 7) disposed in a center of a lower surface of the yoke 9. The dimple 400 may be dimensioned to engage a spherical contact surface of an actuator switch (not shown) (e.g., a ball bearing or a similar shaped actuator). In some embodiments, the dimple 400 may be shaped to accommodate varying contact surfaces of varying switches. The plurality of normally closed contacts 11 are disposed in a plane below the disk spring 8. The plurality of normally open contacts 10 are disposed in a plane above the disk spring 8.

The actuating pin 6 includes a shoulder 404 in contact with an upper surface of the disk spring 8. The pivot ring 5 supports a lower surface of the disk spring 8. The shoulder 404 and pivot ring 5 remains in contact with the disk spring 8 such that a movement away from the header assembly of the actuating pin 6 and shoulder 404 relative to the pivot ring 5 causes the disk spring 8 to snap deflect to a first position to contact the plurality of normally open contacts 10 (shown in FIG. 8A). A movement towards the header assembly of the actuating pin 6 and shoulder 404 relative to the pivot ring 5 causes the disk spring to snap deflect to a second position to contact the plurality of normally closed contacts 11 (shown in FIG. 8B).

FIG. 7 shows a perspective cross-section view of the toggle assembly 50 of FIG. 2A. The adjustment pin 2 may be threaded to the actuating pin 6. Rotating the actuator pin 6 via threads 700 in a first direction extends an overall length of the adjustment pin 2 and actuating pin 6. Rotating the actuator pin 6 via threads 700 in a second direction reduces an overall length of the adjustment pin 2 and actuating pin 6. The actuating pin 6 slides inside the hollow end of a central common terminal 200. The disk spring 8 includes a plurality of "L" shaped apertures 500 extending radially out from a center of the disk spring. The entire contact surface of the disk spring 8 may act as an electrical contact. Accordingly, even if the hermetically sealed chamber in the toggle assembly 50 including the disk spring 8, the plurality of normally open contacts 10, and the plurality of normally closed contacts 11 was breached by gas, or other debris, the large contact surface area and redundancy of contacts ensures continued operation.

The toggle assembly includes two diametrically opposed pivoting pins 4. The first pivoting pin 4 has a proximate end disposed in a first dimple 702 (FIG. 7) of the adjustment pin 2. A distal end of the first pivoting pin 4 is disposed through a first aperture 704 in the yoke 9, and a bulbous pivot point 708 is disposed in a first aperture 706 of a housing 3 of the assembly 50. A first bellows 1 is disposed about the first pivoting pin 4. A second pivoting pin 4 has a proximate end disposed in a second dimple 702 of the adjustment pin 2. A distal end of the second pivoting pin 4 is disposed through a second aperture 704 in the yoke 9, and a bulbous pivot point is disposed in a second aperture 706 of a housing 3 of the assembly 50. A second bellows 1 is disposed about the second pivoting pin 4.

FIG. 8A shows a snapped mode of the toggle assembly 50 of FIG. 2A. Movement of various components relative to one another and upward force 800 are shown with arrows. In one embodiment, said toggle assembly 50 includes said bellows 1, pivoting pins 4, adjustment pin 2, yoke 9, pivoting ring 5, disk spring 8, plurality of normally open contacts 10, and plurality of normally closed contacts 11.

The movement towards the header assembly 7 of the yoke 9 (e.g., via upward force 800, relative to the drawing sheet orientation, from increased pressure by a switch via an advancing disk spring) causes: a movement towards the header assembly 7 of the distal ends of the first and second pivoting pins 4 relative to the bulbous pivot points 708, a movement away from the header assembly 7 of the proximate ends of the first and second pivoting pins 4 relative to the bulbous pivot points 708, a movement away from the header assembly 7 of the adjustment pin 2, a movement away from the header assembly 7 of the actuator pin 6, and a snap deflection of the disk spring 8 to a first position which contacts the plurality of normally open contacts 10.

FIG. 8B shows an unsnapped mode of the disk spring 8 of the toggle assembly 50 of FIG. 2A. Movement of various components relative to one another and downward force 802, relative to the orientation of the drawing sheet, are shown with arrows. The movement away from the header assembly 7 of the yoke 9 (e.g., via downward force 802 from decreased pressure by a switch via a receding disk spring (not shown) and a snap back motion of the contact disk spring 8) causes: a movement away from the header assembly 7 of the distal ends of the first and second pivoting pins 4 relative to the bulbous pivot points 708, a movement towards the header assembly 7 of the proximate ends of the first and second pivoting pins 4 relative to the bulbous pivot points 708, a movement towards the header assembly 7 of the adjustment pin 2, a movement towards the header assembly 7 of the actuating pin 6, and a snap deflection of the disk spring 8 to a second position to contact the plurality of normally closed contacts 11. This second, unsnapped disk spring 8 position is the position of the toggle assembly at zero PSIG acting upon the yoke 9.

Referring to the drawings, in one embodiment the toggle assembly 50 relays increasing force from a pressure switch actuating mechanism (not shown) to a yoke 9 of the toggle assembly 50. A pressure switch is a switch that closes an electrical contact when a set pressure has been reached on its input. The switch may be designed to make contact either on pressure rise or on pressure fall. A typical pressure switch for sensing media pressure contains a capsule, diaphragm or piston element that deforms or displaces proportionally to the applied pressure. The resulting motion is applied to a set of switch contacts.

Referring to FIG. 7, in one embodiment, the toggle switch 50 includes a toggle mechanism comprising said yoke 9, two pivoting bellows 1, adjustment pin 2, drive pin 6, contact disc spring 8, header assembly 7 comprising a central common terminal (pole) 200, and six terminals containing three sets of normally open contact leads 208, 210, 212, and three sets of normally closed contact leads 202, 204, 206. The yoke 9 transmits movement of the disk spring 8 to pivoting bellows 1, pivoting pins 4, the adjustment pin 2, and the actuating pin 6.

The pivoting bellows 1 transmit the movement of an actuating mechanism (not shown) of a pressure switch to drive the contact disc spring 8 via the drive pin 6 and the adjustment pin 2. The ring 5 provides a pivot point for the contact disc spring 8 while insulating the contact disc spring 8 from the body 3 of the toggle assembly 50. The two diametrically opposed pivoting pins 4 transmit force from the yoke 9 to a contact disc spring 8, providing a desired transmission ratio. The drive pin 6 transmits force from the adjustment pin 2 via the pair of pivoting pins 4 to drive the contact disc spring 8. The housing 3 provides mounting points and alignment for other components. The contact disc spring 8 provides "snap action" switching of electrical signal between said normally open (N.O.) and normally closed (N.C.) contacts.

The drive pin 6 transmits force from the adjustment pin 2 directly to contact disc spring 8. This transmits "common" electrical signal from contact disc spring 8 to the common terminal 200 via a sliding (e.g., telescopic) contact between the drive pin 6 and a hollow end of the common terminal 200.

The header assembly 7 transmits an electrical signal through a hermetic glass seal. The header assembly includes multiple normally open contacts 10 and multiple normally closed contacts 11. The normally open contacts 10 are situated on the top side of the plane of the contact disc spring 8 while the normally closed contacts 11 are situated on the bottom side of the plane of the contact disc spring 8.

As described, in a snapped mode, shown in FIG. 8A, the snapped contact disc spring 8 is in physical contact with multiple normally open contacts 10 and away from multiple normally closed contacts 11, thereby establishing electrical continuity between the contact disc spring 8 and multiple normally open contacts 10, closing a circuit that may be coupled to the multiple normally open contacts 10 via corresponding electrical contact leads 208, 210, 212.

In an unsnapped mode, shown in FIG. 8B, the unsnapped disk spring 8 is in physical contact with multiple normally closed contacts 11 and away from normally open contacts 10, thereby establishing electrical continuity between the contact disc spring 8 and multiple normally closed contacts 11, closing a circuit that may be coupled to the multiple normally closed contacts 11 via corresponding electrical contact leads 202, 204, 206.

In one embodiment of the toggle switch 50, with increasing media (e.g., fluid) pressure, an external disk spring (not shown) from a pressure switch drives said toggle mechanism to move the central pin 2, allowing disk spring contact 8 to establish contact between the normally open contacts 10 (FIG. 8A), closing a normally open electrical circuit (such as an electrical circuit of a coupled micro switch).

In FIG. 8A, the direction of the applied load 800 from a pressure switch to the yoke 9 drives the outer end of the pivoting pins 4 towards the header assembly 7 causing the adjustment pin 2 and the actuating pin 6 to propel downward (towards the dimple 400) forcing the contact disc spring 8 to snap deflect, changing the normally open contacts 10 to the closed position. In FIG. 8B, when disk spring load reduces, the reverse occurs, wherein the contact disc spring 8 snap deflects back with force 802 which drives the adjustment pin 2 and the actuating pin 6 towards the header assembly 7 to their original positions, restoring the normally open contacts 10 to their original open positions.

When the media pressure drops, the process is reversed, wherein the internal contact disc spring 8 will snap back and drive the pivoting pins 4 to the original position, such as establishing contact between the contacts 11 (FIG. 8B).

With specific internal pin 4, and contacts 10, 11 configuration, the toggle assembly embodiments/applications can include e.g. single pole, double throw (SPDT), double pole, double throw (DPDT) and triple pole, double throw (TPDT), etc. As such, the toggle assembly 50 serves to increase the reliability by reducing the total quantity of component parts.

The toggle assembly 50 will also have higher vibration characteristics by utilizing a preloaded contact disc spring 8 rather than free canter lever switch contacts.

In one embodiment, a switch design using the toggle assembly 50 takes into consideration factors such as: size, weight, testing, service longevity and cost.

One embodiment of the toggle assembly 50 may have one or more of the following approximate exterior dimensions, wherein: dimension B is a ¾ UN-3A thread, dimension C is 0.45 in. to 0.64 in., dimension D is 0.425 in., dimension E is 0.682 in., dimension F is 0.6875, dimension G is a ¾-32 UN-3A thread, dimension H is a ¾-32 UN-3B thread, dimension I is Ø0.762 to Ø0.766, dimension J is a 13⁄16-32 UN-3A thread, dimension K is about Ø0.8125, and dimension N is Ø0.0635. FIG. 2A shows a side view of the toggle assembly 50 of FIG. 1A rotated 90 degrees. One embodiment of the toggle assembly 50 may have one or more of the following exterior dimensions, wherein: dimension L is 0.876 in., and dimension M is Ø0.813.

A toggle assembly 50 embodiment may include: a disk spring 8; a plurality of normally closed contacts 11 disposed in a plane below the disk spring; a plurality of normally open contacts 10 disposed in a plane above the disk spring; a pivot ring 5 supporting a lower surface of the disk spring; and an actuating pin 6 having a shoulder 404 in contact with an upper surface of the disk spring; where a movement of the actuating pin away from a header assembly 7 snap deflects the disk spring to a first position to contact the plurality of normally open contacts, and a movement of the actuating pin towards the header assembly 7 snap deflects the disk spring to a second position to contact the plurality of normally closed contacts.

The toggle assembly 50 may also include: an adjustment pin 2 rotatably connected to the actuating pin; where rotating the adjustment pin in a first direction extends an overall length of the adjustment pin and actuating pin, and rotating the adjustment pin in a second direction reduces the overall length of the adjustment pin and actuating pin. The assembly may also include: a yoke 9; where a movement of the yoke towards the header assembly causes the movement of the actuating pin away from the header assembly, and a movement of the yoke away from the header assembly causes the movement of the actuating pin towards the header assembly.

The toggle assembly 50 may also include: a first pivoting pin 4 having a proximate end disposed in a first dimple 702 of the adjustment pin, a distal end disposed through a first aperture 704 in the yoke, and a bulbous pivot point 708 disposed in a first aperture 706 of a housing 3 of the assembly; a first bellows 1 disposed about the first pivoting pin; a second pivoting pin 4 having a proximate end disposed in a second dimple 702 of the adjustment pin, a distal end disposed through a second aperture 704 in the yoke, and a bulbous pivot point 708 disposed in a second aperture 706 of the housing of the assembly; and a second bellows 1 disposed about the second pivoting pin; where the first pivoting pin is diametrically opposed from the second pivoting pin. The movement of the yoke towards the header assembly causes: a movement towards the header assembly of the distal ends of the first and second pivoting pins relative to the bulbous pivot points 708 and a movement away from the header assembly of the proximate ends of the first and second pivoting pins relative to the bulbous pivot points 708. The movement of the yoke away from the header assembly causes: a movement away from the header assembly of the distal ends of the first and second pivoting pins relative to the bulbous pivot points 708 and a movement towards the header assembly of the proximate ends of the first and second pivoting pins relative to the bulbous pivot points 708.

The plurality of normally closed contacts 11 include said three normally closed contact leads 202, 204, 206. The plurality of normally open contacts 10 include said three normally open contact leads 208, 210, 212. The plurality of normally open contact leads 208, 210, 212 are each disposed equidistant from a center 201 of the disk spring. The plurality of normally closed contact leads 202, 204, 206 are each disposed equidistant from the center of the disk spring. Each of the plurality of normally open contact leads 208, 210, 212 are disposed closer to the center 201 of the disk spring 8 than each of the plurality of normally contact leads 202, 204, 206.

The disk spring, the plurality of normally closed contacts/leads, and the plurality of normally open contacts/leads are disposed in a hermetically sealed chamber in a housing 3 of the assembly. The disk spring comprises a plurality of "L" shaped apertures 500 extending radially out from a center 201 of the disk spring. The yoke further comprises a dimple 400 disposed in a center of a lower surface of the yoke, wherein the dimple is dimensioned to engage a spherical contact surface of a switch. The actuating pin is connected to a central common terminal 200.

In applications of the switch assembly disclosed herein as a microswitch, the disclosed switch assembly has a large contact area with redundant contact in a hermetically sealed chamber as compared to a single contact with a small contact with a contact area in a hermetically sealed chamber. If gas, or other debris, enters the hermetically sealed chamber the contact and/or contact area of a traditional microswitch may easily corrode causing failure of the microswitch. Existing microswiches have numerous parts, low vibration resistance, low shock resistance, and are not suitable in high-temperature applications.

Those skilled in the art will appreciate that various adaptations and modifications of the described preferred embodiments can be configured without departing from the scope and spirit of the improved pressure switch system described herein. Therefore, it is to be understood that, within the scope of the embodiments, the switch system may be practiced other than as specifically described herein.

What is claimed is:

1. An assembly comprising:

a disk spring;

a plurality of normally closed contacts disposed in a plane below the disk spring;

a plurality of normally open contacts disposed in a plane above the disk spring;

a pivot ring supporting a lower surface of the disk spring;

an actuating pin having a shoulder in contact with an upper surface of the disk spring;

a yoke;

a first pivoting pin having a proximate end disposed in a first dimple of an adjustment pin, a distal end disposed through a first aperture in the yoke, and a bulbous pivot point disposed in a first aperture of a housing of the assembly;

a first bellows disposed about the first pivoting pin;

a second pivoting pin having a proximate end disposed in a second dimple of the adjustment pin, a distal end disposed through a second aperture in the yoke, and a bulbous pivot point disposed in a second aperture of the housing of the assembly; and a second bellows disposed about the second pivoting pin;

wherein the first pivoting pin is diametrically opposed from the second pivoting pin;

wherein a movement of the actuating pin away from a header assembly snap deflects the disk spring to a first position to contact the plurality of normally open contacts, and a movement of the actuating pin towards the header assembly snap deflects the disk spring to a second position to contact the plurality of normally closed contacts; and wherein a movement of the yoke towards the header assembly causes the movement of the actuating pin away from the header assembly, and a movement of the yoke away from the header assembly causes the movement of the actuating pin towards the header assembly.

2. The assembly of claim 1 further comprising:

the adjustment pin rotatably connected to the actuating pin;

wherein rotating the adjustment pin in a first direction extends an overall length of the adjustment pin and actuating pin, and rotating the adjustment pin in a second direction reduces the overall length of the adjustment pin and actuating pin.

3. The assembly of claim 1 wherein the movement of the yoke towards the header assembly causes: a movement towards the header assembly of the distal ends of the first and second pivoting pins relative to the bulbous pivot points and a movement away from the header assembly of the proximate ends of the first and second pivoting pins relative to the bulbous pivot points.

4. The assembly of claim 1 wherein the movement of the yoke away from the header assembly causes: a movement away from the header assembly of the distal ends of the first and second pivoting pins relative to the bulbous pivot points and a movement towards the header assembly of the proximate ends of the first and second pivoting pins relative to the bulbous pivot points.

5. The assembly of claim 1 wherein the plurality of normally closed contacts comprises three normally closed contact leads.

6. The assembly of claim 5 wherein the plurality of normally open contacts comprises three normally open contact leads.

7. The assembly of claim 1 wherein the disk spring, the plurality of normally closed contacts, and the plurality of normally open contacts are disposed in a hermetically sealed chamber in a housing of the assembly.

8. The assembly of claim 1 wherein the disk spring comprises a plurality of "L" shaped apertures extending radially out from a center of the disk spring.

9. An assembly comprising:

a disk spring;

a plurality of normally closed contacts disposed in a plane below the disk spring;

a plurality of normally open contacts disposed in a plane above the disk spring;

a pivot ring supporting a lower surface of the disk spring; and an actuating pin having a shoulder in contact with an upper surface of the disk spring;

wherein a movement of the actuating pin away from a header assembly snap deflects the disk spring to a first position to contact the plurality of normally open contacts, and a movement of the actuating pin towards the header assembly snap deflects the disk spring to a second position to contact the plurality of normally closed contacts;

wherein the plurality of normally open contacts are each disposed equidistant from a center of the disk spring;

wherein the plurality of normally closed contacts are each disposed equidistant from the center of the disk spring; and wherein each of the plurality of normally open contacts are disposed closer to the center of the disk spring than each of the plurality of normally closed contacts.

10. An assembly comprising:

a disk spring;

a plurality of normally closed contacts disposed in a plane below the disk spring;

a plurality of normally open contacts disposed in a plane above the disk spring;

a pivot ring supporting a lower surface of the disk spring;

an actuating pin having a shoulder in contact with an upper surface of the disk spring; and a yoke;

wherein a movement of the actuating pin away from a header assembly snap deflects the disk spring to a first position to contact the plurality of normally open contacts, and a movement of the actuating pin towards the header assembly snap deflects the disk spring to a second position to contact the plurality of normally closed contacts;

wherein a movement of the yoke towards the header assembly causes the movement of the actuating pin away from the header assembly, and a movement of the yoke away from the header assembly causes the movement of the actuating pin towards the header assembly;

wherein the yoke further comprises a dimple disposed in a center of a lower surface of the yoke, wherein the dimple is dimensioned to engage a spherical contact surface of a switch.

11. An assembly comprising:

a disk spring;

a plurality of normally closed contacts disposed in a plane below the disk spring;

a plurality of normally open contacts disposed in a plane above the disk spring;

a pivot ring supporting a lower surface of the disk spring; and an actuating pin having a shoulder in contact with an upper surface of the disk spring;

wherein a movement of the actuating pin away from a header assembly snap deflects the disk spring to a first position to contact the plurality of normally open contacts, and a movement of the actuating pin towards the header assembly snap deflects the disk spring to a second position to contact the plurality of normally closed contacts; and wherein the actuating pin is connected to a central common terminal.

12. The assembly of claim 11 further comprising:

an adjustment pin rotatably connected to the actuating pin;

wherein rotating the adjustment pin in a first direction extends an overall length of the adjustment pin and actuating pin, and rotating the adjustment pin in a second direction reduces the overall length of the adjustment pin and actuating pin.

13. The assembly of claim 11 further comprising:

a yoke;

wherein a movement of the yoke towards the header assembly causes the movement of the actuating pin away from the header assembly, and a movement of the yoke away from the header assembly causes the movement of the actuating pin towards the header assembly.

14. The assembly of claim 11 wherein the plurality of normally closed contacts comprises three normally closed contact leads.

15. The assembly of claim 11 wherein the plurality of normally open contacts comprises three normally open contact leads.

16. The assembly of claim 11 wherein the plurality of normally closed contacts are each disposed equidistant from the center of the disk spring.

17. The assembly of claim 11 wherein the disk spring, the plurality of normally closed contacts, and the plurality of normally open contacts are disposed in a hermetically sealed chamber in a housing of the assembly.

18. The assembly of claim 11 wherein the disk spring comprises a plurality of "L" shaped apertures extending radially out from a center of the disk spring.

19. An assembly comprising:

a disk spring;

a plurality of normally closed contacts disposed in a first plane;

a plurality of normally open contacts disposed in a second plane, wherein the first plane and the second plane are separated by the disk spring;

a pivot ring supporting a first surface of the disk spring; and an actuating pin having a shoulder in contact with a second surface of the disk spring;

wherein a movement of the actuating pin in a first direction snap deflects the disk spring to a first position to contact the plurality of normally open contacts, and a movement of the actuating pin in a second opposite direction snap deflects the disk spring to a second position to contact the plurality of normally closed; wherein at least one of: each of the plurality of normally open contacts are disposed closer to a center of the disk spring than each of the plurality of normally closed contacts, and each of the plurality of normally closed contacts are disposed closer to the center of the disk spring than each of the plurality of normally open contacts; and wherein the actuating pin is connected to a central common terminal.

* * * * *